US006596096B2

(12) United States Patent
Carl et al.

(10) Patent No.: US 6,596,096 B2
(45) Date of Patent: Jul. 22, 2003

(54) PERMANENT MAGNET FOR ELECTROMAGNETIC DEVICE AND METHOD OF MAKING

(75) Inventors: Ralph James Carl, Clifton Park, NY (US); Gerald Burt Kliman, Niskayuna, NY (US); Juliana Chiang Shei, Niskayuna, NY (US); Mark Gilbert Benz, Burnt Hills, NY (US); Judson Sloan Marte, Wynantskill, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/929,644

(22) Filed: Aug. 14, 2001

(65) Prior Publication Data

US 2003/0070729 A1 Apr. 17, 2003

(51) Int. Cl.[7] ..... H01F 1/057
(52) U.S. Cl. ..... 148/101; 148/104; 252/62.54
(58) Field of Search ..... 148/302, 101, 148/103, 104; 252/62.54

(56) References Cited

U.S. PATENT DOCUMENTS

| | | | | |
|---|---|---|---|---|
| 4,496,395 A | | 1/1985 | Croat | |
| 4,558,077 A | | 12/1985 | Gray | |
| 4,765,848 A | * | 8/1988 | Mohri et al. | 148/302 |
| 4,778,542 A | | 10/1988 | Clemens | |
| 4,781,754 A | | 11/1988 | Soranno et al. | |
| 4,802,931 A | | 2/1989 | Croat | |
| 4,836,868 A | * | 6/1989 | Yajima et al. | 148/302 |
| 4,842,656 A | | 6/1989 | Maines et al. | |
| 4,851,058 A | * | 7/1989 | Croat | 148/302 |
| 4,902,361 A | | 2/1990 | Lee et al. | |
| 5,172,751 A | | 12/1992 | Croat | |
| 5,174,362 A | | 12/1992 | Croat | |
| 5,288,447 A | | 2/1994 | Day | |
| 5,356,984 A | | 10/1994 | Carbone et al. | |
| 6,120,620 A | | 9/2000 | Benz et al. | |
| 6,359,359 B1 | | 3/2002 | Miura et al. | |

FOREIGN PATENT DOCUMENTS

WO WO0122438 A1 3/2001

OTHER PUBLICATIONS

US 4,756,775, 7/1988, Croat (withdrawn)
J. Croat "Magnetic Hardening of PR–FE and ND–FE Alloys by Melt–Spinning", J. Appl. Phys. 53(4), Apr. 1982, pp. 3161–3168.
Y. Luo, "Review of the NDFEB Patent Situation", Magnews Summer 2001, pp. 15–19.
U.S. patent application Entitled "Method and Apparatus for Magnetizing a Permanent Magnet" by Km Amm, et al (Attorney Docket Rd–29,209) Ser. No. and filing date not yet assigned.
Peter Campbell, "Permanent Magnet Materials and Their Application", 1994, pp. 72–73.

* cited by examiner

*Primary Examiner*—John Sheehan
(74) *Attorney, Agent, or Firm*—Noreen C. Johnson; Philip D. Freedman

(57) ABSTRACT

Permanent magnets, devices including permanent magnets and methods for manufacture are described with the permanent magnet comprising, for example: iron-boron-rare earth alloy particulate having an intrinsic coercive force of at least about 1591 kiloamperes/meter (about 20 kiloOersteds) and a residual magnetization of at least about 0.8 tesla (about 8 kiloGauss), wherein the rare earth content comprises praseodymium, a light rare earth element selected from the group consisting of cerium, lanthanum, yttrium and mixtures thereof, and balance neodymium; and a binder bonding the particulate.

5 Claims, 2 Drawing Sheets

PERMANENT MAGNET FOR ELECTROMAGNETIC DEVICE AND METHOD OF MAKING

BACKGROUND

The invention relates generally to permanent magnet materials, methods of making permanent magnet materials, and electromagnetic devices including permanent magnet materials.

Many types of electromechanical energy converters such as motors, generators, and actuators use permanent magnets to create an open circuit flux density which interacts with a field created by an electric circuit to provide torque. To a large extent, the size and efficiency of a converter of a given power rating is determined by the "energy density" of the magnet in the device. The higher the open circuit air gap flux density produced by the magnet, the more torque that can be produced per unit weight and the higher the motor efficiency for a given power input. Open circuit flux is determined by the strength of the magnet and the effective length of the air gap. The stronger the magnet and the smaller the effective air gap, the more efficient and smaller the machine.

As a practical matter, cost savings can be achieved by making the magnets as thin as feasible while providing a sufficient thickness to prevent demagnetization from armature reaction flux density. As compared with thicker magnets, thinner magnets require less space. However, the permanent magnets are typically designed to be thick so as to avoid experiencing an operating point that might result in demagnetization. For example, magnet thicknesses for 373 Watt (one-half horse power) motors typically range from about 2.54 millimeters (about 0.1 inches) to about 7.62 millimeters (about 0.3 inches).

It would be desirable to have a permanent magnetic material not constrained by conventional thicknesses and having high residual magnetization and large intrinsic coercive force.

SUMMARY

Briefly, in accordance with one embodiment of the present invention, a permanent magnet comprises: iron-boron-rare earth alloy particulate having an intrinsic coercive force of at least about 1591 kiloamperes/meter (about 20 kiloOersteds) and a residual magnetization of at least about 0.8 tesla (about 8 kiloGauss), wherein the rare earth content comprises praseodymium, a light rare earth element selected from the group consisting of cerium, lanthanum, yttrium and mixtures thereof, and balance neodymium; and a binder bonding the particulate.

In accordance with another embodiment of the present invention, a method of fabricating at least one permanent magnet comprises: providing iron-boron-rare earth alloy particulate having an intrinsic coercive force of at least about 1591 kiloamperes/meter (about 20 kiloOersteds) and a residual magnetization of at least about 0.8 tesla (about 8 kiloGauss), wherein the rare earth content comprises praseodymium, a light rare earth element selected from the group consisting of cerium, lanthanum, yttrium and mixtures thereof, and balance neodymium; providing a binder; bonding the particulate with the binder to provide moldable particulate material; and molding the at least one permanent magnet from the moldable particulate material.

DRAWINGS

These and other features, aspects, and advantages of the present invention will become better understood when the following detailed description is read with reference to the accompanying drawings in which like characters represent like parts throughout the drawings, wherein.

DESCRIPTION

Figure 1:
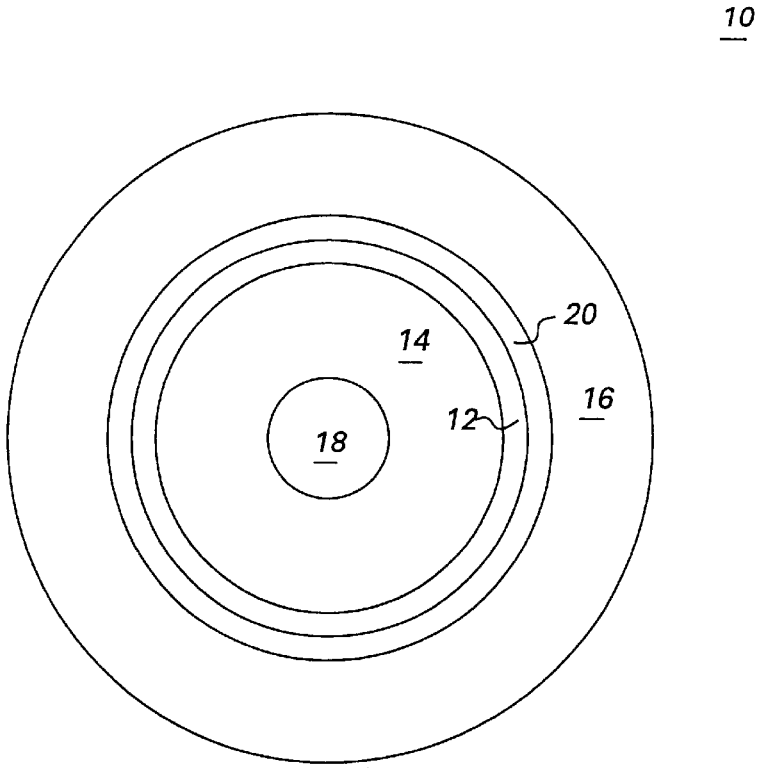
FIG. 1 is a sectional schematic view of an electromechanical energy converter comprising a permanent magnet according to one embodiment of the present invention.

Commonly assigned Benz et al., U.S. Pat. No. 6,120,620, describes a permanent magnet having substantially stable magnetic properties and having as the active magnetic component a sintered product of compacted iron-boron-rare earth intermetallic powders. The sintered product has pores which are substantially non-interconnecting, a density of at least 87 percent of theoretical and a composition consisting essentially of, in atomic percent, about 13 to about 19 percent rare earth elements, about 4 to about 20 percent boron, and about 61 to about 83 percent of iron with or without impurities; where the rare earth content is greater than 50 percent praseodymium with an effective amount of a light rare earth selected from the group consisting of cerium, lanthanum, yttrium and mixtures thereof, and balance neodymium.

It has been discovered that magnetic properties of particulate obtained from the permanent magnet material of aforementioned U.S. Pat. No. 6,120,620 have a significantly higher than expected intrinsic coercive force ($H_{ci}$) as compared with the permanent magnet material of aforementioned U.S. Pat. No. 6,120,620 and as compared with other commercially available magnetic particulate. Thus permanent magnets in applications such as rotational electromechanical energy converters (motors and generators, for example) and translational electromechanical energy converters (actuators, for example) can be made thinner than in conventional embodiments with a resulting decrease in magnet and air gap length which decreases the cost and size of a motor.

Furthermore, as compared with sintered permanent magnets, permanent magnets bound with a binder (molded magnets) have several other advantages including, for example, simpler and less expensive fabrication techniques, ease of integration with other molding operations, and, depending upon the binder, intrinsic protection of the magnetic material from corrosive conditions. Sintered magnets are brittle and therefore are difficult to fabricate into complex shapes and cannot be made with thicknesses much less than about 4.57 millimeters (about 0.18 inches).

In accordance with one embodiment of the present invention, a permanent magnet comprises: iron-boron-rare earth alloy particulate having an intrinsic coercive force (herein meaning the intrinsic coercive force when fully magnetized) of at least about 1591 kiloamperes/meter (about 20 kiloOersteds), wherein the rare earth content comprises praseodymium, a light rare earth element selected from the group consisting of cerium, lanthanum, yttrium and mixtures thereof, and balance neodymium; and a binder bonding the particulate. Even more specifically, in one embodiment the particulate comprises a material having a residual magnetization (herein meaning the residual magnetization when fully magnetized) of at least about 0.8 tesla (about 8 kiloGauss).

As used herein, "having an intrinsic coercive force of at least about 1591 kiloamperes/meter (about 20 kiloOersteds)" is intended to encompass particulate which would have such intrinsic coercive force when fully magnetized regardless of whether such magnetization has yet occurred. Likewise, as used herein "having a residual magnetization of at least about 0.8 tesla (about 8 kiloGauss)" is intended to encompass particulate which would have such residual magnetization when fully magnetized regardless of whether such magnetization has yet occurred.

A particularly useful form of the particulate has been found to be fractured flakes of rapidly-solidified molten alloy. "Melt-solidified" is meant to include material which has been melted and rapidly quenched. In melt-spinning (a more specific example of melt-solidifying) rapid quenching is performed on a rotating surface. In one example, the flakes are formed by melt-spinning an iron-boron-rare earth alloy and fracturing the flakes from the melt-spun iron-boron-rare earth alloy. In a more specific (but more expensive) example, the iron-boron-rare earth alloy is sintered prior to being melt-spun. Aforementioned U.S. Pat. No. 6,120,620 describes a useful technique for sintering. Croat, U.S. Pat. No. 5,172,751 describes one technique for melt-spinning by re-melting an alloy into a quartz crucible and expressing the alloy through a small nozzle onto a rotating chill surface to produce thin ribbons of alloy which are rapidly quenched (cooled) on the rotating chill surface. As compared with sintering, melt-solidifying of the same alloy of U.S. Pat. No. 6,120,620 resulted in improving the magnetic hardening (intrinsic coercive force) while maintaining beneficial residual magnetization.

After fracturing, in one embodiment, flake sizes of the particulate range from about 30 micrometers to about 300 micrometers. Although no specific flake size is viewed as necessary for the present invention, it is useful to have flakes which are at least as large as the particulate grain size. In one embodiment, the grains of iron-boron-rare earth alloy particulate comprise tetragonal phase grains.

In an embodiment wherein the alloy of aforementioned U.S. Pat. No. 6,120,620 is used, the iron-boron-rare earth alloy particulate comprises: about 13 to about 19 atomic percent rare earth, where the rare earth content consists essentially of greater than 50 percent praseodymium, a light rare earth selected from the group consisting of cerium, lanthanum, yttrium and mixtures thereof, and balance neodymium; about 4 to about 20 atomic percent boron; and balance iron with or without impurities. In more specific embodiments, the light rare earth is present in an amount less than or equal to about 10 percent of the total rare earth content and/or the praseodymium is present in an amount greater than about 70 percent of the total rare earth content.

Using embodiments of the present invention, the iron-boron-rare earth alloy particulate is expected to have an intrinsic coercive force of at least about 1591 kiloamperes/meter (about 20 kiloOersteds) and a residual magnetization of at least about 0.8 tesla (about 8 kiloGauss) at a temperature of about 20° C.

EXAMPLE

In one embodiment the sintered iron-boron-rare earth material described in aforementioned U.S. Pat. No. 6,120,620 having a composition of $(PR_{0.71}Nd_{0.27}Ce_{0.02})_2Fe_{14}B$ was melt-solidified in accordance with the technique described in aforementioned U.S. Pat. No. 5,172,751 and then fractured to form flakes. The anticipated flake size distribution (based on commercially available neodymium products) is as follows.

| size | mesh | % |
|---|---|---|
| >250 micron | 60 mesh | 15% |
| 149–250 micron | 100 mesh | 44% |
| 50–149 micron | 200 mesh | 30% |
| <50 micron | 270 mesh | 11% |

The resulting particulate had grains which were not substantially magnetically aligned (a feature which benefits the intrinsic coercive force) and was found to have an intrinsic coercive force ($H_{ci}$) of about 1671 kiloamperes/meter (about 21 kiloOersteds) and a residual magnetization of about 0.8 Tesla (about 8 kiloGauss) at room temperature when fully magnetized.

The demagnetization curve for the particulate was determined with a vibrating sample magnetometer. A sample of the particulate was mounted and packed in a cement in a tube and was magnetized in an applied field of about 2000 kiloamperes/meter (25 kiloOersteds) at 100° C. The sample was magnetized at an elevated temperature to achieve as full saturation of the sample as possible given the maximum field capability of the instrument of 2000 kiloamperes/meter. Heating a magnetic material prior to magnetization is useful to achieve full magnetization during the magnetization process.

More specifically, the following steps were undertaken in the present example: an un-magnetized sample of particulate was heated to 100° C.; an electromagnetic field was applied and slowly ramped to a maximum value of 2000 kiloamperes/meter (25 kiloOersteds). The applied field was then slowly reduced to zero. The sample was allowed to cool to room temperature. The residual magnetization at room temperature was recorded. A negative field was applied and slowly ramped in magnitude until the intrinsic coercive force was indicated. The residual magnetism achieved by magnetizing the sample in an applied field of 2000 kiloamperes/meter (25 kiloOersteds) and 100° C. was about 30% higher than that achieved by magnetizing the sample at the same field but at room temperature (about 20° C.). The intrinsic coercive force was improved by less than about 5% by magnetizing the sample at 100° C. compared with magnetizing the sample at 20° C.

Figure 3:
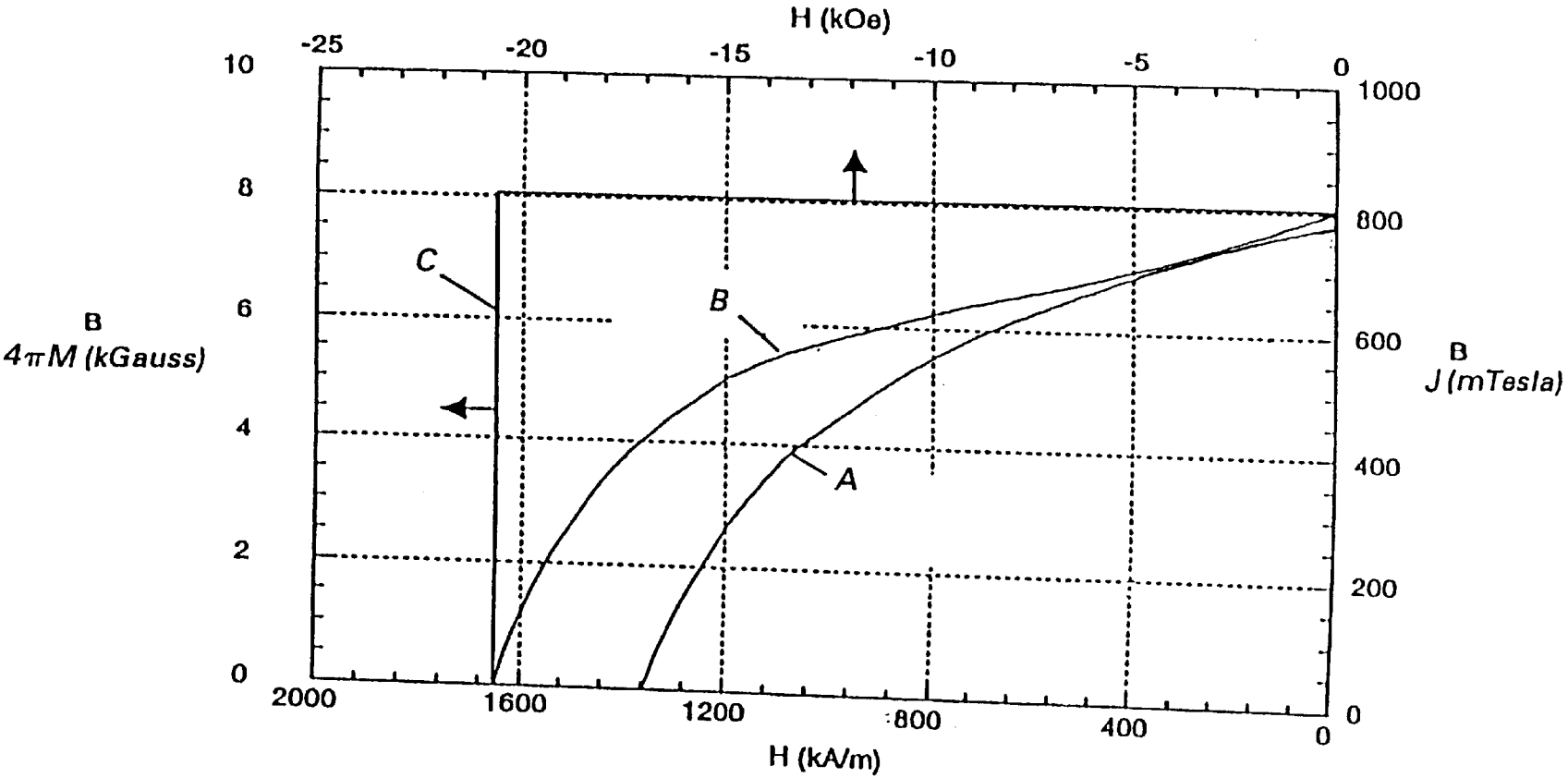
FIG. 3 is a second quadrant polarization plot illustrating magnetization versus magnetic field for the particulate of the permanent magnet in accordance with one embodiment of the present invention.

FIG. 3 is a polarization plot of magnetization (J) versus magnetic field (H) for the particulate in accordance with the above example. In FIG. 3, curve A represents a conventional polarization curve, curve B represents a polarization curve using material of the above example, and curve C represents an ideal polarization curve with the arrows symbolizing the goal of maximizing the intrinsic coercive force, maximizing the residual magnetization, and having a wide range (shown in FIG. 3 as about 0 kiloamperes/meter to about 1100 kiloamperes/meter for example) where the relationship between magnetization and field is constant or at least linear. As represented by curve B, the intrinsic coercive force of the material in the above example is significantly greater than that of the conventional materials of curve A without a significant sacrifice of residual magnetization. The combination of the intrinsic coercive force and residual magnetization properties is particularly advantageous for molding permanent magnets for use in electromagnetic devices.

As can be seen in the graph, the particulate not only exhibits high intrinsic coercive force, but also a wide range of substantially linear behavior of magnetization verses field. These properties enable permanent magnets made from the particulate to be subjected to high demagnetizing fields without significant loss of magnetization. Thus the permanent magnet in electrical machines can be made thinner than conventional magnets without risk of demagnetization of the magnet by the armature field (at room temperature). For example, with commercially available powders, the maximum reverse field that may be applied at room temperature without loss of strength of the magnet is about 440 kiloamperes/meter. It is expected that, for a magnet comprising particulate of the present invention, the maximum reverse field that can be applied at room temperature with out loss of magnet strength is about 880 kiloamperes/meter. In practice, it is expected that the particulate will typically be bonded with the binder and molded to form the permanent magnet prior to being heated and magnetized.

The binder may comprise any appropriate bonding material. In one embodiment, the binder comprises a polymeric material. In a more specific embodiment, the polymeric material is at least one polyarylene ether, polyamide, polyester, polyimide, polycarbonate, polyetherimide, polysulfone, polyamideimide, polyethersulfone, polyetherketone, polyetheretherketone, polyethylene, polyphenylene ether, liquid crystal polyester, syndiotatic polystryene, polyetherketoneketone, polyphenylenesulfide, or copolymers or mixtures thereof.

In another embodiment, binders may comprise at least one of any thermoset polymer. Suitable thermoset polymer binders include, but are not limited to, those derived from epoxies, cyanate esters, unsaturated polyesters, diallylphthalate, acrylics, alkyds, phenol-formaldehyde, novolacs, resoles, bismaleimides, PMR resins, melamine-formaldehyde, urea-formaldehyde, benzocyclobutanes, hydroxymethylfurans, and isocyanates. In one embodiment of the invention the thermoset polymer binder further comprises at least one thermoplastic polymer, such as, but not limited to, polyphenylene ether, polyphenylene sulfide, polysulfone, polyetherimide, or polyester.

The choice of binder is dependant on several factors including strength; temperature stability and environmental protection over fabrication and operating ranges; capability of wetting the particulate well for protection and sealing; capability of providing for homogeneous distribution of particulate; and achievable volume fraction of particulate in the binder for a given molding process. Experience has demonstrated that residual magnetization of a bonded magnet is equal to the volume fraction of particulate-to-binder multiplied by the residual magnetization of the particulate. Higher volume fractions of particulate-to-binder can provide higher residual magnetization values of resulting magnets and thus can be useful in permitting fabrication of thin magnets.

Several specific binder material options are discussed below in additional detail for purposes of example.

Polyarylene ether binders generally comprise arylene structural units joined by ether linkages. The polyarylene ethers are most often polyphenylene ethers having structural units of the formula:

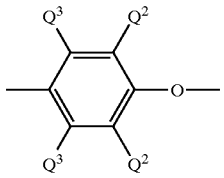

wherein each $Q^2$ is independently halogen, primary or secondary lower alkyl, phenyl, haloalkyl, aminoalkyl, hydrocarbonoxy, or halohydrocarbonoxy wherein at least two carbon atoms separate the halogen and oxygen atoms, and each $Q^3$ is independently hydrogen, halogen, primary or secondary lower alkyl, phenyl, haloalkyl, hydrocarbonoxy or halohydrocarbonoxy as defined for $Q^2$.

Both homopolymer and copolymer polyphenylene ethers are included. In various embodiments homopolymers are those including 2,6-dimethyl-1,4-phenylene ether units. In various embodiments copolymers include random copolymers including 2,6-dimethyl-1,4-phenylene ether units in combination with, for example, 2,3,6-trimethyl-1,4-phenylene ether units. Also included are polyphenylene ethers including moieties prepared by grafting onto the polyphenylene ether in known manner such materials as vinyl monomers or polymers such as polystyrenes and elastomers, as well as coupled polyphenylene ethers in which coupling agents such as low molecular weight polycarbonates, quinones, heterocycles and formals undergo reaction in known manner with the hydroxy groups of two polyphenylene ether chains to produce a higher molecular weight polymer.

The polyphenylene ethers have an intrinsic viscosity in the range of about 0.09–0.6 deciliters per gram (dl./g.), as measured in chloroform at 25° C. The polyphenylene ethers are typically prepared by the oxidative coupling of at least one monohydroxyaromatic compound such as 2,6-xylenol or 2,3,6-trimethylphenol. Catalyst systems are generally employed for such coupling; they typically include at least one heavy metal compound such as a copper, manganese or cobalt compound, usually in combination with various other materials.

Particularly useful polyphenylene ethers for many purposes are those which comprise molecules having at least one aminoalkyl-containing end group. Typically the aminoalkyl radical is covalently bound to a carbon atom located in an ortho position to a hydroxy group. Polyphenylene ethers including such end groups may be obtained by incorporating an appropriate primary or secondary monoamine such as di-n-butylamine or dimethylamine as one of the constituents of the oxidative coupling reaction mixture. Also frequently present are 4-hydroxybiphenyl end groups and/or biphenyl structural units, typically obtained from reaction mixtures in which a by-product diphenoquinone is present, especially in a copper-halide-secondary or tertiary amine system. A substantial proportion of the polymer molecules, typically constituting as much as about 90% by weight of the polymer, may include at least one of said aminoalkyl-containing and 4-hydroxy-biphenyl end groups. It will be apparent to those skilled in the art from the foregoing that the polyphenylene ethers contemplated for use in the invention include all those presently known, irrespective of variations in structural units or ancillary chemical features.

In some embodiments binders comprising polyarylene ethers may comprise at least one other resinous component in a blend with polyarylene ether. In one embodiment the polyarylene ether is a polyphenylene ether such as poly(2,6-dimethy-1,4-phenylene ether). Resinous components suitable for blending with polyphenylene ethers include, but are not limited to, addition polymers. Suitable addition polymers include homopolymers and copolymers, especially homopolymers of alkenylaromatic compounds, such as polystyrene, including syndiotactic polystyrene.

Polyamide binders suitable for use in the present invention may be made by any known method. Suitable polyamides include those of the type prepared by the polymerization of a monoamino-monocarboxylic acid or a lactam thereof having at least 2 carbon atoms between the amino and carboxylic acid group; or of substantially equimolar proportions of a diamine which includes at least 2 carbon atoms between the amino groups and a dicarboxylic acid; or of a monoaminocarboxylic acid or a lactam thereof as defined above together with substantially equimolar proportions of a diamine and a dicarboxylic acid. The dicarboxylic acid may be used in the form of a functional derivative thereof, for example, an ester or acid chloride.

Examples of the aforementioned monoamino-monocarboxylic acids or lactams thereof which are useful in preparing the polyamides include those compounds including from 2 to 16 carbon atoms between the amino and carboxylic acid groups, said carbon atoms forming a ring with the —CO—NH— group in the case of a lactam. As particular examples of aminocarboxylic acids and lactams there may be mentioned 6-aminocaproic acid, butyrolactam, pivalolactam, eta-caprolactam, capryllactam, enantholactam, undecanolactam, dodecanolactam and 3- and 4-aminobenzoic acids.

Diamines suitable for use in the preparation of the polyamides include the straight chain and branched chain alkyl, aryl and alkaryl diamines. Illustrative diamines are trimethylenediamine, tetramethylenediamine, pentamethylenediamine, octamethylenediamine, hexamethylenediamine, trimethylhexamethylenediamine, m-phenylene-diamine and m-xylylenediamine.

Suitable dicarboxylic acids include those which include an aliphatic or aromatic group including at least 2 carbon atoms separating the carboxy groups. The aliphatic acids include sebacic acid, octadecanedioic acid, suberic acid, glutaric acid, pimelic acid and adipic acid, for example.

In certain embodiments polyamides may include a substantial proportion of either amine end groups or carboxylic acid end groups, or both of amine end groups and carboxylic acid end groups. In some embodiments the comprise poly (hexamethylene adipamide), typically designated "polyamide-66", and/or poly(6-aminocaproamide), typically designated "polyamide-6".

Polyester binders for use in the present invention may be made by any conventional method and, in one embodiment, for example, such binders comprise thermoplastic polyesters prepared by a condensation polymerization process. Illustrative polyesters are poly(alkylene dicarboxylates), including poly(ethylene terephthalate) (sometimes designated "PET"), poly(1,4-butylene terephthalate) (sometimes designated "PBT"), poly(trimethylene terephthalate) (sometimes designated "PTT"), poly(ethylene naphthalate) (sometimes designated "PEN"), poly(1,4-butylene naphthalate) (sometimes designated "PBN"), poly (cyclohexanedimethanol terephthalate) (sometimes designated "PCT"), poly(cyclohexanedimethanol-co-ethylene terephthalate) (sometimes designated "PETG"), and poly(1,4-cyclohexanedimethyl-1,4-cyclohexanedicarboxylate) (sometimes designated "PCCD"), and especially poly (alkylene arenedioates). Mixtures of poly(alkylene dicarboxylates) may also be employed.

Polyarylates are also suitable binder materials. Polyarylates include those with structural units comprising at least one dihydric phenol and at least one aromatic dicarboxylic acid. Illustrative examples include polyarylates comprising terephthalate and/or isophthalate structural units in combination with one or more of unsubstituted resorcinol, substituted resorcinol, and bisphenol A.

Binders in the present invention may alternatively comprise at least one polyimide. Useful thermoplastic polyimides include those of the general formula (I)

(I)

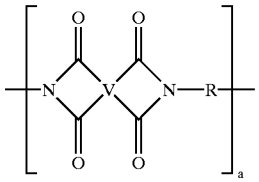

wherein a is an integer greater than 1, for example, in the range from about 10 to about 10,000 or more; and V is a tetravalent linker without limitation, as long as the linker does not impede synthesis or use of the thermoplastic polyimide. Suitable linkers include but are not limited to: (a) substituted or unsubstituted, saturated, unsaturated or aromatic monocyclic and polycyclic groups having about 5 to about 50 carbon atoms, (b) substituted or unsubstituted, linear or branched, saturated or unsaturated alkyl groups having 1 to about 30 carbon atoms; or combinations thereof. Suitable substitutions and/or linkers include, but are not limited to, ethers, epoxides, amides, esters, and combinations thereof. In one embodiment, linkers include but are not limited to tetravalent aromatic radicals of formula (II), such as (II)

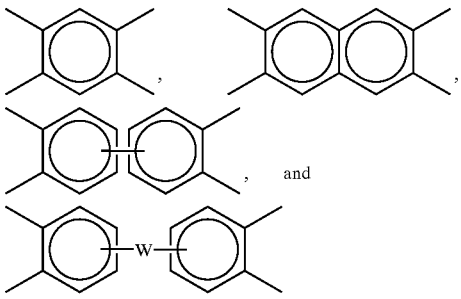

wherein W is a divalent moiety selected from the group consisting of —O—, —S—, —C(O)—, —$SO_2$—, $C_yH_{2y}$ (y being an integer from 1 to 5), and halogenated derivatives thereof, including perfluoroalkylene groups, or a group of the formula —O—Z —O—wherein the divalent bonds of the —O— or the —O—Z —O—group are in the 3,3',3,4', 4,3', or the 4,4'positions, and wherein Z includes, but is not limited, to divalent radicals of formula (III).

(III)

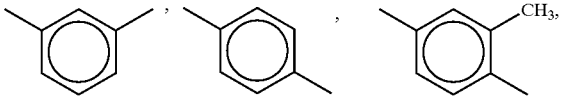

-continued

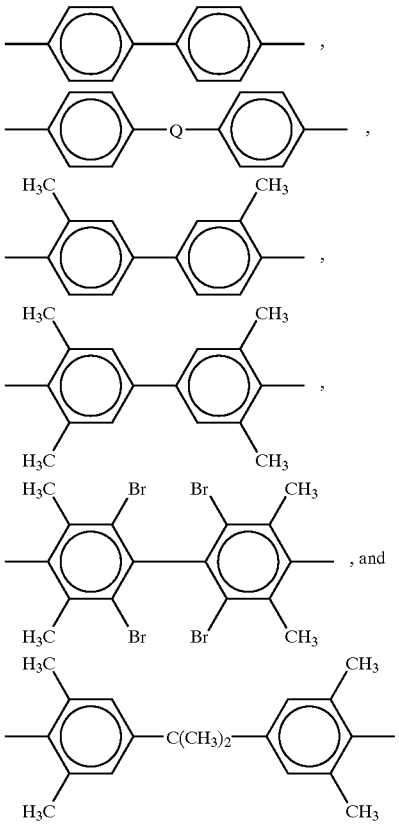

wherein Q includes but is not limited to divalent a divalent moiety selected from the group consisting of —O—, —S—, —C(O)—, —$SO_2$—, $C_yH_{2y}$ (y being an integer from 1 to 5), and halogenated derivatives thereof, including perfluoroalkylene groups.

R in formula (I) includes, but is not limited to, substituted or unsubstituted divalent organic radicals such as: (a) aromatic hydrocarbon radicals having about 6 to about 20 carbon atoms and halogenated derivatives thereof; (b) straight or branched chain alkylene radicals having about 2 to about 20 carbon atoms; (c) cycloalkylene radicals having about 3 to about 20 carbon atoms, or (d) divalent radicals of the general formula (IV)

(IV)

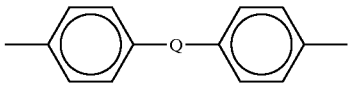

wherein Q is as defined above.

In various embodiments classes of polyimides include polyamidimides, polyetherimide/polyimide copolymers, and polyetherimides, particularly those polyetherimides known in the art which are melt processible. In one embodiment polyetherimide resins comprise more than 1, typically about 10 to about 1000 or more, and more specifically about 10 to about 500 structural units, of the formula (V)

(V)

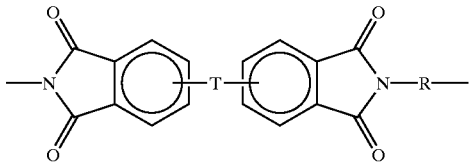

wherein R is as defined above for formula (I); T is —O— or a group of the formula —O—Z—O— wherein the divalent bonds of the —O— or the —O—Z—O— group are in the 3,3',3,4', 4,3', or the 4,4', positions, and wherein Z includes, but is not limited, to divalent radicals of formula (III) as defined above.

In one embodiment, the polyetherimide may comprise a copolymer which, in addition to the etherimide units described above, further includes polyimide structural units of the formula (VI)

(VI)

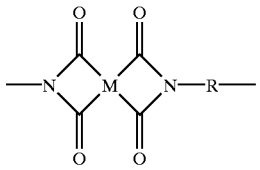

wherein R is as previously defined for formula (I) and M includes, but is not limited to, radicals of formula (VII).

(VII)

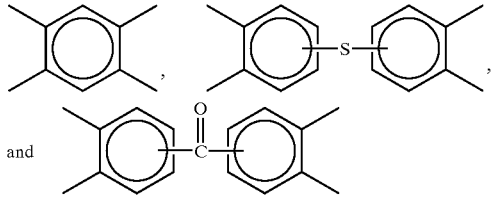

The polyetherimide can be prepared by any of the methods well known to those skilled in the art, including the reaction of an aromatic bis(ether anhydride) of the formula (VIII)

(VIII)

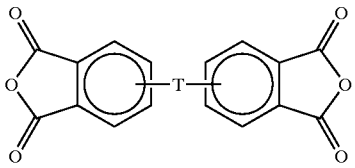

with an organic diamine of the formula (IX)

$$H_2N—R—NH_2 \quad (IX)$$

wherein T and R are defined as described above in formulas (I) and (V).

Illustrative examples of aromatic bis(ether anhydride)s of formula (VIII) include: 2,2-bis[4-(3,4-dicarboxyphenoxy) phenyl]propane dianhydride; 4,4'-bis(3,4-dicarboxyphenoxy)diphenyl ether dianhydride; 4,4'-bis(3,4-dicarboxyphenoxy) diphenyl sulfide dianhydride; 4,4'-bis(3,4-dicarboxyphenoxy) benzophenone dianhydride; 4,4'-bis (3,4-dicarboxyphenoxy) diphenyl sulfone dianhydride; 2,2-bis[4-(2,3-dicarboxyphenoxy)phenyl]propane dianhydride; 4,4'bis(2,3-dicarboxyphenoxy) diphenyl ether dianhydride; 4,4'-bis(2,3-dicarboxyphenoxy) diphenyl sulfide dianhydride; 4,4'-bis(2,3-dicarboxyphenoxy) benzophenone dianhydride; 4,4'-bis(2,3-dicarboxyphenoxy) diphenyl sulfone dianhydride; 4-(2,3-dicarboxyphenoxy)-4'-(3,4-dicarboxyphenoxy) diphenyl-2,2-propane dianhydride; 4-(2,3-dicarboxyphenoxy)-4'-(3,4-dicarboxyphenoxy) diphenyl ether dianhydride; 4-(2,3-dicarboxyphenoxy)-4'(3,4-dicarboxyphenoxy) diphenyl sulfide dianhydride; 4-(2,3-dicarboxyphenoxy)-4'(3,4-dicarboxyphenoxy) benzophenone dianhydride and 4-(2,3-dicarboxyphenoxy)-4'(3,4-dicarboxyphenoxy) diphenyl sulfone dianhydride, as well as various mixtures thereof.

The bis(ether anhydride)s can be prepared by the hydrolysis, followed by dehydration, of the reaction product of a nitro substituted phenyl dinitrile with a metal salt of dihydric phenol compound in the presence of a dipolar, aprotic solvent. An exemplary class of aromatic bis(ether anhydride)s encompassed by formula (VIII) above includes, but is not limited to, compounds wherein T is of the formula (X)

(X)

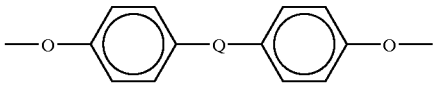

and the ether linkages, for example, are typically in the 3,3',3,4',4,3', or 4,4'positions, and mixtures thereof, and where Q is as defined above.

Any diamino compound may be employed in the method of this invention. Examples of suitable compounds are ethylenediamine, propylenediamine, trimethylenetetramine, diethylenetriamine, triethylenetetramine, hexamethylenediamine, heptamethylenediamine, octamethylenediamine, nonamethylenediamine, decamethylenediamine, 1,12-dodecanediamine, 1,18-octadecanediamine, 3-methylheptamethylenediamine, 4,4-dimethylheptamethylenediamine, 4-methylnonamethylenediamine, 5-methylnonamethylenediamine, 2,5-dimethylhexamethylenediamine, 2,5-dimethylheptamethylenediamine, 2,2-dimethylpropylenediamine, N-methyl-bis(3-aminopropyl) amine, 3-methoxyhexamethylenediamine, 1,2-bis(3-aminopropoxy) ethane, bis(3-aminopropyl) sulfide, 1,4-cyclohexanediamine, bis-(4-aminocyclohexyl) methane, m-phenylenediamine, p-phenylenediamine, 2,4-diaminotoluene, 2,6-diaminotoluene, m-xylylenediamine, p-xylylenediamine, 2-methyl-4,6-diethyl-1,3-phenylenediamine, 5-methyl-4,6-diethyl-1,3-phenylenediamine, benzidine, 3,3'-dimethylbenzidine, 3,3'-dimethoxybenzidine, 1,5-diaminonaphthalene, bis(4-aminophenyl) methane, bis(2-chloro-4-amino-3,5-diethylphenyl) methane, bis(4-aminophenyl) propane, 2,4-bis(b-amino-t-butyl) toluene, bis(p-b-amino-t-butylphenyl) ether, bis(p-b-methyl-o-aminophenyl) benzene, bis(p-b-methyl-o-aminopentyl) benzene, 1,3-diamino-4-isopropylbenzene, bis(4-aminophenyl) sulfide, bis(4-aminophenyl) sulfone, bis(4-aminophenyl) ether and 1,3-bis(3-aminopropyl) tetramethyldisiloxane. Mixtures of these compounds may also be present. Several useful diamino compounds include, for example, aromatic diamines, especially m-and p-phenylenediamine and mixtures thereof.

In a particular embodiment, the polyetherimide resin comprises structural units according to formula (V) wherein each R is independently p-phenylene or m-phenylene or a mixture thereof and T is a divalent radical of the formula (XI)

(XI)

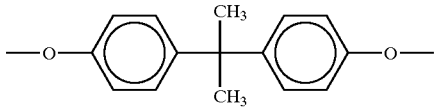

Generally, useful polyetherimides have a melt index of about 0.1 to about 10 grams per minute ("g/min"), as measured by American Society for Testing Materials ("ASTM") D1238 at 337° C., using a 6.6 kilogram ("kg") weight. In one embodiment, the polyetherimide resin has a weight average molecular weight (Mw) of about 10,000 to about 150,000 grams per mole ("g/mole"), as measured by gel permeation chromatography, using a polystyrene standard. Such polyetherimide resins typically have an intrinsic viscosity [η] ranging from about 0.2 deciliters per gram to about 0.7 deciliters per gram measured in m-cresol at 25° C. Some such polyetherimides include, but are not limited to those sold by GE Plastics under the trademark ULTEM and include Ultem 1000 (number average molecular weight (Mn) about 21,000; weight average molecular weight (Mw) about 54,000; dispersity about 2.5), Ultem 1010 (Mn about 19,000; Mw about 47,000; dispersity about 2.5), Ultem 1040 (Mn about 12,000; Mw 34,000–35,000; dispersity about 2.9), or mixtures thereof.

In various embodiments polycarbonate binders of the present invention comprise structural units derived from at least one dihydric phenol and a carbonate precursor. Suitable dihydric phenols include those represented by the formula (XII):

HO---D-OH (XII)

wherein D is a divalent aromatic radical. In various embodiments D has the structure of formula (XIII);

(XIII)

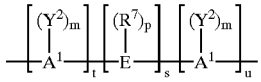

wherein $A^1$ represents an aromatic group such as phenylene, biphenylene, naphthylene, etc., E may comprise an alkylene or alkylidene group including, but not limited to, methylene, ethylene, ethylidene, propylene, propylidene, isopropylidene, butylene, butylidene, isobutylidene, amylene, amylidene, isoamylidene. When E is an alkylene or alkylidene group, it may also consist of two or more alkylene or alkylidene groups connected by a moiety different from alkylene or alkylidene, such as an aromatic linkage; a tertiary amino linkage; an ether linkage; a carbonyl linkage; a silicon-containing linkage; or a sulfur-containing linkage including, but not limited to, sulfide, sulfoxide, sulfone; or a phosphorus-containing linkage including, but not limited to, phosphinyl, phosphonyl. In addition, E may comprise a cycloaliphatic group including, but not limited to, cyclopentylidene, cyclohexylidene, 3,3,5-trimethylcyclohexylidene, methylcyclohexylidene, 2-[2.2.1]-bicycloheptylidene, neopentylidene, cyclopentadecylidene, cyclododecylidene, adamantylidene; a sulfur-containing linkage, such as sulfide, sulfoxide or sulfone; a phosphorus-containing linkage, such as phosphinyl or phosphonyl; an ether linkage; a carbonyl group; a tertiary nitrogen group; or a silicon-containing linkage such as silane or siloxy. $R^7$ represents hydrogen or a monovalent hydrocarbon group such as alkyl, aryl, aralkyl, alkaryl, or cycloalkyl. In various embodiments a monovalent hydrocarbon group of $R^7$ may comprise halogen-substituted, particularly fluoro- or chloro-substituted, for example as in dichloroalkylidene. $Y^2$ may comprise an inorganic atom including, but not limited to, halogen (fluorine, bromine, chlorine, iodine); an inorganic group including, but not limited to, nitro; an organic group including, but not limited to, a monovalent hydrocarbon group such as alkyl, aryl, aralkyl, alkaryl, or cycloalkyl, or an oxy group such as $OR^8$, wherein $R^8$ is a monovalent hydrocarbon group such as alkyl, aryl, aralkyl, alkaryl, or cycloalkyl; it being only necessary that $Y^2$ be inert to and unaffected by the reactants and reaction conditions used to prepare a polycarbonate. The letter "m" represents any integer from and including zero through the number of positions on $A^1$ available for substitution; "p" represents an integer from and including zero through the number of positions on E available for substitution; "t" represents an integer equal to at least one; "s" is either zero or one; and "u" represents any integer including zero.

When more than one $y^2$ substituent is present as represented by formula (XIII) above, they may be the same or different. When more than one $R^7$ substituent is present, they may be the same or different. Where "s" is zero in formula (XIII) and "u" is not zero, the aromatic rings are directly joined with no intervening alkylidene or other bridge. The positions of the hydroxyl groups and $Y^2$ on the aromatic residues $A^1$ can be varied in the ortho, meta, or para positions and the groupings can be in vicinal, asymmetrical or symmetrical relationship, where two or more ring carbon atoms of the aromatic residue are substituted with $Y^2$ and hydroxyl groups.

In various embodiments dihydric phenols include 6-hydroxy-1-(4'-hydroxyphenyl)-1.3,3-trimethylindane, 4,4'-(3,3,5-trimethylcyclohexylidene)diphenol; 1,1-bis(4-hydroxy-3-methylphenyl)cyclohexane; 2,2-bis(4-hydroxyphenyl)propane (commonly known as bisphenol-A); 2,2-bis(4-hydroxy-3,5-dimethylphenyl)propane; 2,2-bis(4-hydroxy-3-methylphenyl)propane; 2,2-bis(4-hydroxy-3-ethylphenyl) propane; 2,2-bis(4-hydroxy-3-isopropylphenyl)propane; 2,4'-dihydroxydiphenylmethane; bis(2-hydroxyphenyl)methane; bis(4-hydroxy-phenyl) methane; bis(4-hydroxy-5-nitrophenyl)methane; bis(4-hydroxy-2,6-dimethyl-3-methoxyphenyl)methane; 1,1-bis(4-hydroxyphenyl)ethane; 1,1-bis(4-hydroxy-2-chlorophenyl) ethane; 2,2-bis(3-phenyl-4-hydroxyphenyl)-propane; bis(4-hydroxyphenyl) cyclohexylmethane; 2,2-bis(4-hydroxyphenyl)-1-phenylpropane; 6,6'-dihydroxy-3,3,3',3'-tetramethyl-1,1'-spirobiindane (sometimes know as "SBI"); hydroquinone, resorcinol; $C_{1-3}$ alkyl-substituted resorcinols.

In various embodiments the carbonate precursor for preparing polycarbonates include at least one carbonyl halide, carbonate ester or haloformate. The carbonyl halides which can be employed herein are carbonyl chloride, carbonyl bromide and mixtures thereof. Typical carbonate esters which may be employed herein include, but are not limited to, diaryl carbonates, including, but not limited to, diphenylcarbonate, di(halophenyl)carbonates, di(chlorophenyl)carbonate, di(bromophenyl)carbonate, di(trichlorophenyl)carbonate, di(tribromophenyl)carbonate; di(alkylphenyl)carbonates, di(tolyl)carbonate; di(naphthyl) carbonate, di(chloronaphthyl)carbonate, phenyl tolyl carbonate, chlorophenyl chloronaphthyl carbonate, di(methyl salicyl)carbonate, and mixtures thereof. The haloformates suitable for use herein include bishaloformates of dihydric phenols, which include, but are not limited to, bischloroformates of hydroquinone; bisphenol-A; 3-(4-hydroxyphenyl)-1,1,3-trimethylindan-5-ol; 1-(4-hydroxyphenyl) -1,3,3-trimethylindan-5-ol; 4,4'-(3,3,5-trimethylcyclohexylidene)diphenol; 1,1-bis(4-hydroxy-3-methylphenyl)cyclohexane; bischloroformate-terminated polycarbonate oligomers such as oligomers comprising hydroquinone, bisphenol-A, 3-(4-hydroxyphenyl)-1,1,3-trimethylindan-5-ol; 1-(4-hydroxyphenyl)-1,3,3-trimethylindan-5-ol; 4,4'-(3,3,5-trimethylcyclohexylidene) diphenol, 1,1-bis(4-hydroxy-3-methylphenyl) cyclohexane; and bishaloformates of glycols including, but not limited to, bishaloformates of ethylene glycol, neopentyl glycol, and polyethylene glycol. Mixtures of haloformates may be employed. In a particular embodiment carbonyl chloride, also known as phosgene, is employed. In another particular embodiment diphenylcarbonate is employed.

Binders may employ any suitable polycarbonate known in the art. In one embodiment a suitable polycarbonate is a bisphenol A polycarbonate. In some embodiments resinous binders comprising polycarbonates may comprise at least one other resinous component in a blend with polycarbonate. Resinous components suitable for blending with polycarbonate include, but are not limited to, polyesters, illustrative examples of which include polyalkylene terephthalates such as polybutylene terephthalate and polyethylene terephthalate. Resinous components suitable for blending with polycarbonate also include addition polymers. Suitable addition polymers include copolymers of alkenylaromatic compounds with ethylenically unsaturated nitrites, such as acrylonitrile and methacrylonitrile; dienes, such as butadiene and isoprene; and/or acrylic monomers, such as ethyl acrylate. These latter copolymers include the ABS (acrylonitrile-butadiene-styrene) and ASA (acrylonitrile-styrene-acrylate) copolymers. Illustrative acrylate comonomers include alkyl acrylates such as ethyl acrylate and butyl acrylate.

The particulate may be combined (compounded) with binder using any known method. In one embodiment the particulate may be combined with thermoplastic binder in a process which may comprise steps of mixing the particulate with thermoplastic resin, dispersing particulate within thermoplastic resin matrix, and either molding shortly thereafter or isolating (packaging for transport) the binder-particulate mixture. Dispersing particulate within thermoplastic resin matrix may be performed using known methods, illustrative examples of which include slurry or melt methods. Melt methods include those performed in any type of melt-processing equipment, illustrative examples of which include melt mixers, extruders, and kneaders. Any process used to combine particulate with binder can be a batch, semi-continuous, or continuous process.

In some embodiments the order of mixing of particulate with thermoplastic binder may comprise combining particulate with thermoplastic binder and then adding to melt-processing equipment or adding particulate to any melt-processing equipment after the thermoplastic binder, for example, through addition of particulate at a down-stream feedport of an extruder to which thermoplastic binder has been fed at an initial feedport. In various embodiments particulate may be combined with thermoplastic binder as the particulate alone or as a mixture with another substance, for example, as a concentrate of particulate in a thermoplastic binder, particularly the binder within which the particulate is to be dispersed. In various embodiments in melt-processing equipment commonly known additives for thermoplastics may be included such as, for example, antioxidants, antistatic agents, inert fillers, ultraviolet radiation absorbers, heat stabilizers, hydrolytic stabilizers, impact modifiers, mold release agents, color stabilizers, flame retardants. Whatever process is used, particulate-thermoplastic binder composites may be isolated using standard methods including, if desired, converting the composite into pellets. In one embodiment, particulate is combined with thermoplastic binder in a melt process in which a processing aid has been adding to the mixture. Examples of processing aids include known plasticizers and also other polymers miscible with thermoplastic binder, such as polystyrene which is miscible with poly(phenylene ether)s.

When a thermoset material is used as a binder, particulate and any optional thermoplastic polymer are typically combined with a thermoset monomer mixture before curing of said thermoset material.

When combining the particulate and the binder, in one embodiment, a fraction density of particulate to binder is at least about 55 percent. In a more specific embodiment, the fraction density ranges from about 60 percent to about 90 percent.

Although the binder has been described as a polymer above for purposes of example, any material suitable for binding may be used. For example, the binder may comprise an inorganic material such as ferrite particles or a ferrite coating on the particulate. Molding a permanent magnet from the particulate-binder mixture may be performed by conventional techniques such as compression and injection molding, for example.

Figure 2:
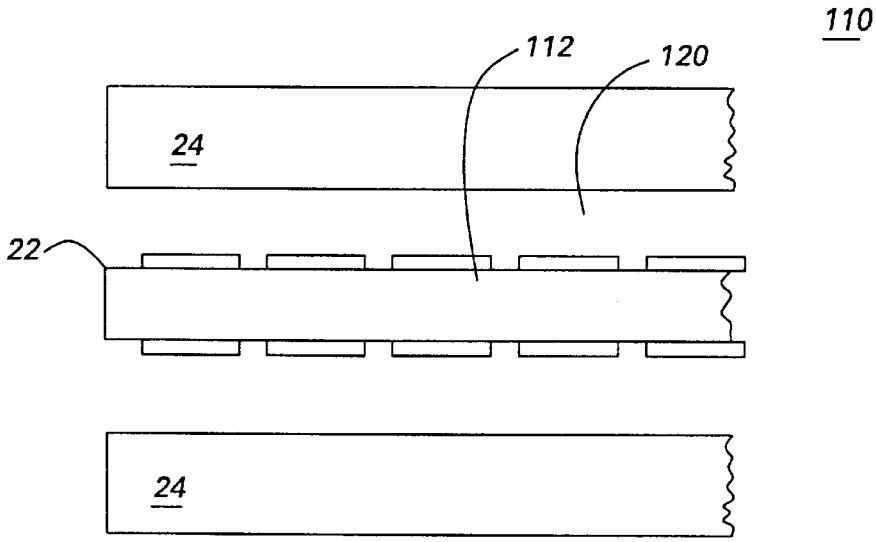
FIG. 2 is another sectional schematic view of an electromechanical energy converter comprising a permanent magnet according to another embodiment of the present invention.

Several embodiments wherein the particulate and binder combination are particularly useful are depicted in FIGS. 1–2 wherein FIG. 1 is a sectional schematic view of a rotational electromechanical energy converter 10 comprising a permanent magnet 12, and FIG. 2 is another sectional schematic view of a translational electromechanical energy converter 110 comprising a permanent magnet 112. Converter 10 of FIG. 1 (which may comprise a motor or generator, for example) includes a rotor 14 having a rotor bore 18 therein and permanent magnet 12 situated thereon, a stator 16, and a gap 20 between the rotor and the stator. Permanent magnet 12 may be molded prior to being positioned on rotor 14. Alternatively, permanent magnet 12 may be molded directly onto rotor 14 by any appropriate method. If desired for a particular application, a corrosion resistant coating (not shown) may be present around at least a portion of the permanent magnet. One description of direct molding techniques can be found, for example, in commonly assigned Day, U.S. Pat. No. 5,288,447. The previously described molded magnet embodiments of the present invention can be used to provide a magnetic field strength that enables the permanent magnet to operate on a lower load line with reduced risk of demagnetization and thus permits a thinner magnet and air gap (that is, the combined radial length of permanent magnet 12 and air gap 20). Converter 110 of FIG. 2 includes a stationary element 24, a moving element 22 with permanent magnets 112, and an air gap 120 between the moving element and the stationary elements.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claim is:

1. A method of fabricating a permanent magnet, comprising:

sintering to form an iron-boron-rare earth alloy;

fracturing the sintered iron-boron-rare earth alloy into particulates having a rare earth content comprising (1) praseodymium, (2) cerium, lanthanum or yttrium and (3) neodymium; and the binding the particulates with a binder to provide a moldable material; and molding moldable material into a permanent magnet.

2. The method of claim 1, comprising sintering, melt solidifying the iron-boron-rare earth alloy and fracturing the alloy into the particulates.

3. The method of claim 1, comprising sintering, melt spinning the iron-boron-rare earth alloy and fracturing the alloy into the particulates.

4. The method of claim 1, comprising melt solidifying the sintered alloy and fracturing the solidified and sintered alloy into the particulates.

5. The method of claim 1 further comprising heating and then magnetizing the particulates.

* * * * *